US006968787B2

(12) United States Patent
Heidel et al.

(10) Patent No.: US 6,968,787 B2
(45) Date of Patent: Nov. 29, 2005

(54) GAMING TABLE VALIDATOR ASSEMBLY

(75) Inventors: Raymond Heidel, Henderson, NV (US); Gwen D. Mathis, Las Vegas, NV (US)

(73) Assignee: JCM American Corporation, Las Vegas, NV (US)

( * ) Notice: Subject to any disclaimer, the term of this patent is extended or adjusted under 35 U.S.C. 154(b) by 11 days.

(21) Appl. No.: 10/863,059

(22) Filed: Jun. 7, 2004

(65) Prior Publication Data

US 2004/0222061 A1 Nov. 11, 2004

Related U.S. Application Data

(63) Continuation of application No. 10/081,756, filed on Feb. 20, 2002, now Pat. No. 6,745,887.

(51) Int. Cl.[7] ..... G07D 7/00
(52) U.S. Cl. ..... 104/206; 194/302
(58) Field of Search ..... 194/206, 350, 194/207, 215, 216, 217, 302; 109/1 R, 45; 273/292, 294; 463/29, 46

(56) References Cited

U.S. PATENT DOCUMENTS

| | | | | |
|---|---|---|---|---|
| 4,614,342 A | | 9/1986 | Takashima | 273/85 |
| 4,746,110 A | | 5/1988 | Chiba | 271/3.14 |
| 4,813,675 A | | 3/1989 | Greenwood | 463/46 |
| 5,078,405 A | | 1/1992 | Jones et al. | 273/309 |
| 5,112,060 A | * | 5/1992 | Jones | 273/309 |
| 5,113,990 A | | 5/1992 | Gabrius et al. | 194/206 |
| 5,290,033 A | | 3/1994 | Bittner et al. | 273/138 |
| 5,301,618 A | | 4/1994 | Abendschein et al. | 109/55 |
| 5,393,067 A | | 2/1995 | Paulsen et al. | 273/292 |
| 5,559,312 A | | 9/1996 | Lucero | 235/380 |
| 5,588,650 A | | 12/1996 | Eman et al. | 273/142 |
| 5,655,961 A | | 8/1997 | Acres et al. | 463/27 |
| 5,737,418 A | | 4/1998 | Saffari et al. | 380/9 |
| 5,775,993 A | | 7/1998 | Fentz et al. | 463/17 |
| 5,779,546 A | | 7/1998 | Meissner et al. | 463/25 |
| 5,823,875 A | | 10/1998 | Tarantino | 463/29 |
| 5,836,818 A | | 11/1998 | Jones et al. | 463/29 |
| 5,907,141 A | | 5/1999 | Deaville et al. | 235/375 |
| 5,934,998 A | * | 8/1999 | Forte et al. | 463/12 |
| 5,957,776 A | | 9/1999 | Hoehne | 463/25 |
| 6,048,269 A | | 4/2000 | Burns et al. | 463/25 |
| 6,264,556 B1 | | 7/2001 | Izawa et al. | 463/25 |
| 6,530,836 B2 | | 3/2003 | Soltys et al. | 463/29 |
| 6,561,897 B1 | * | 5/2003 | Bourbour et al. | 463/13 |
| 6,745,887 B2 | | 6/2004 | Heidel et al. | 194/206 |

FOREIGN PATENT DOCUMENTS

| | | |
|---|---|---|
| DE | 4138261 A1 | 5/1993 |
| EP | 0805408 | 11/1997 |
| GB | 2186412 | 8/1987 |
| GB | 2230371 A | 10/1990 |
| GB | 2284913 | 6/1995 |
| WO | WO01/91065 | 11/2001 |

*Primary Examiner*—Donald P. Walsh
*Assistant Examiner*—Mark J. Beauchaine
(74) *Attorney, Agent, or Firm*—Squire, Sanders & Dempsey L.L.P.

(57) ABSTRACT

A bill acceptor assembly for accepting bills, vouchers, scrip, tickets and/or currency at a gaming table. The bill acceptor assembly includes a validator assembly capable of accepting a stack of individual notes in a receiving slot mounted to the gaming table, processing the notes one at a time, and passing valid notes through a hole in the gaming table or along the back edge of the gaming table to a cash box located below the gaming table.

20 Claims, 4 Drawing Sheets

GAMING TABLE VALIDATOR ASSEMBLY

This is a continuation application of U.S. patent application Ser. No. 10/081,756 filed Feb. 20, 2002, U.S. Pat. No. 6,745,887.

BACKGROUND OF THE INVENTION

1. Field of the Invention

The present invention is directed to a bill acceptor adapted for mounting on a gaming table. In particular, the invention relates to a bill acceptor which can accept a stack of individual notes in a receiving slot mounted to the gaming table, processes the notes one at a time and pass valid notes through a hole in the gaming table or along the back edge of the gaming table to a cash box located below the gaming table.

2. General Background and State of the Art

Conventional gaming tables located in casinos are generally used to play games such as blackjack, poker, roulette, baccarat, and craps. The table may have an outer periphery containing a plurality of player locations and a dealer's location located generally opposite the player locations. From the dealer's location, the dealer controls the pace and operation of the game including for example dealing the cards, paying winning wagers and collecting losing wagers.

A dealer's responsibilities also include exchanging currency or notes received from a player for casino chips. Generally, when a player wants to exchange currency or notes for chips at the gaming table, the player gives the currency or notes to the dealer. Notes, as used herein, can include local and foreign currency, casino scrip, and casino issued tickets. The dealer counts out and then spreads the currency or notes on the playing surface of the gaming table. The dealer is sometimes required to notify a pit boss that the dealer is exchanging currency or notes. After receiving an approval from the pit boss, the dealer accepts the currency or notes and deposits them into a slot accessible from the playing surface of the gaming table. The slot leads to a channel for transporting the currency or notes from the slot to a cash box located below the playing surface. A plate may be used to push the currency or notes into the slot and ensure that the currency or notes properly fall into the cash box.

The revenues received on the gaming tables are a significant source of income for a casino. Accordingly, the high volume of currency or notes exchanged invites the risks of receiving counterfeit currency or notes. Unlike slot machines, wherein the implementation of integrated bill acceptors in the slot machines has diminished the casinos' risk of receiving counterfeit currency, most gaming tables remain susceptible to this risk. Due to the increased sophistication of counterfeiters and the increasing difficulties in discriminating between authentic and counterfeit currency, the manual or dealer inspection method of accepting currency on gaming tables is inadequate to protect casinos from currency fraud. Also, as the use of casino scrip and casino tickets increases, there is a risk that these forms of revenue could be compromised or counterfeited. Accurate accounting of these alternative forms of notes may require that they be validated upon receipt.

A few attempts have been made to patent the use of a bill acceptor assembly on electronic gaming tables. For example, U.S. Pat. No. 5,775,993 ("the '993 Patent") issued to Fentz et al. discloses a bill acceptor assembly mounted at each player station located around an electronic roulette wheel. Similarly, in U.S. Pat. No. 5,588,650 ("the '650 Patent"), each player console located around an automated roulette wheel includes a bill acceptor. In both of these patents, a computer, not a human being, directs the game. A player can insert money into the bill acceptor to earn credits at any time, even though the player may not be able to place a bet until the next betting period. Yet, both the '993 Patent and the '650 Patent have two fundamental flaws. First, both patents use traditional single-feed bill acceptors where the player must insert one note at a time into the bill acceptor. The bill acceptors in the '993 Patent and the '650 Patent are not designed to accept multiple notes at one time. At a gaming table, players may start their betting with a large sum of money which, in the configuration of the '993 or '650 Patents, would require each player to feed each note one at a time into the bill acceptor. The effort involved in feeding each note can be time consuming and frustrating, and even more so if the bill acceptor does not accept every note on,the first feeding attempt.

Second, incorporating a bill acceptor into a computerized gaming table does not involve the same difficulties as incorporating a bill acceptor into a conventional gaming table operated by a human being. On the computerized gaming table, a computer using preprogrammed software manages each player's credits, operates the game, calculates and pays out all winnings, and collects any losing wagers. No casino tokens or notes are dispensed until a player cashes out. On the other hand, a gaming table operator has to do all of the functions by himself or herself. In addition, the operator is given the responsibility of watching each player to ensure that he/she does not cheat. Neither the '993 Patent nor the '650 Patent explain or address the many concerns of how to incorporate the bill acceptor into a human operated gaming table. For example, neither patent discloses how the operator would know how much money has been inserted into the bill acceptor. This disconnect in information would prevent the operator from knowing how many tokens to give back to the player.

Accordingly, a system for accepting valid currency and rejecting counterfeit currency on a conventional gaming table would be beneficial to the gaming industry. Such a system would increase the casino's profitability by decreasing the amount of counterfeit currency it may receive. Moreover, a bill acceptor capable of accepting and validating a stack of notes would significantly decrease the delay involved in feeding one note at a time into the bill acceptor.

SUMMARY OF THE INVENTION

The present invention is directed to a note or bill acceptor, which will accept various notes, located on a gaming table. Due to the expansion of the types of currency and currency substitutes which are accepted by current bill acceptors on current casino gaming machines, bills, vouchers, script, tickets and currency will be hereinafter collectively referred to as "notes." The bill acceptor of the present invention is directed to providing an efficient way to accept notes on a gaming table and simultaneously discriminate between authentic and counterfeit notes. Accordingly, a bill acceptor for accepting and rejecting notes on a gaming table is set forth which includes a validator assembly having a slot for receiving notes and an associated transport mechanism to pull the notes from the slot through the validator assembly. If the note is not authentic, the note is transported to a bill rejection slot. If the note is authentic, the transport mechanism directs the note through an enclosed path down through (or around) the surface of the gaming table to a cash box. The bill acceptor is mounted to the gaming table with a mounting bracket, preferable so as to take advantage of the existing slot in the top of the gaming table into which the dealer or operator would normally insert the notes.

According to the present invention, a player or the dealer places notes on a bezel leading to a bill insertion slot of the bill acceptor, which is preferably capable of receiving multiple notes. The bill acceptor removes one note at a time from the others and uses various optical and magnetic sensors to determine the authenticity of each note. If the note does not meet the standards of the bill acceptor for any reason, the note is rejected. The transport mechanism will divert the rejected note to the bill rejection slot, where the note is returned to the playing surface of the gaming table. If the note is valid, a transport mechanism conveys the note to a cash box for storage. A display will indicate the total value of the notes received. An override "Accept" button, to allow the dealer to accept a questionable note is also included to allow the dealer to accept the notes, even though the bill acceptor is rejecting them.

The accepted notes may be securely and orderly stacked inside the cash box if the cash box is configured to include a stacker. A lock on the cash box door prevents unauthorized access to the notes inside the cash box. Moreover, the bill acceptor and cash box can be assembled from more than one component to ensure ease of installation onto the gaming table. Further, a bill guard can be installed around the bill acceptor to minimize the possibility that a player would reach over the gaming table and attempt to remove the notes as they were being fed into or rejected from the bill acceptor.

The above described and many other features and advantages of the present invention will become apparent from a consideration of the following detailed description in conjunction with the accompanying drawings.

DETAILED DESCRIPTION OF THE PREFERRED EMBODIMENTS

Figure 1:
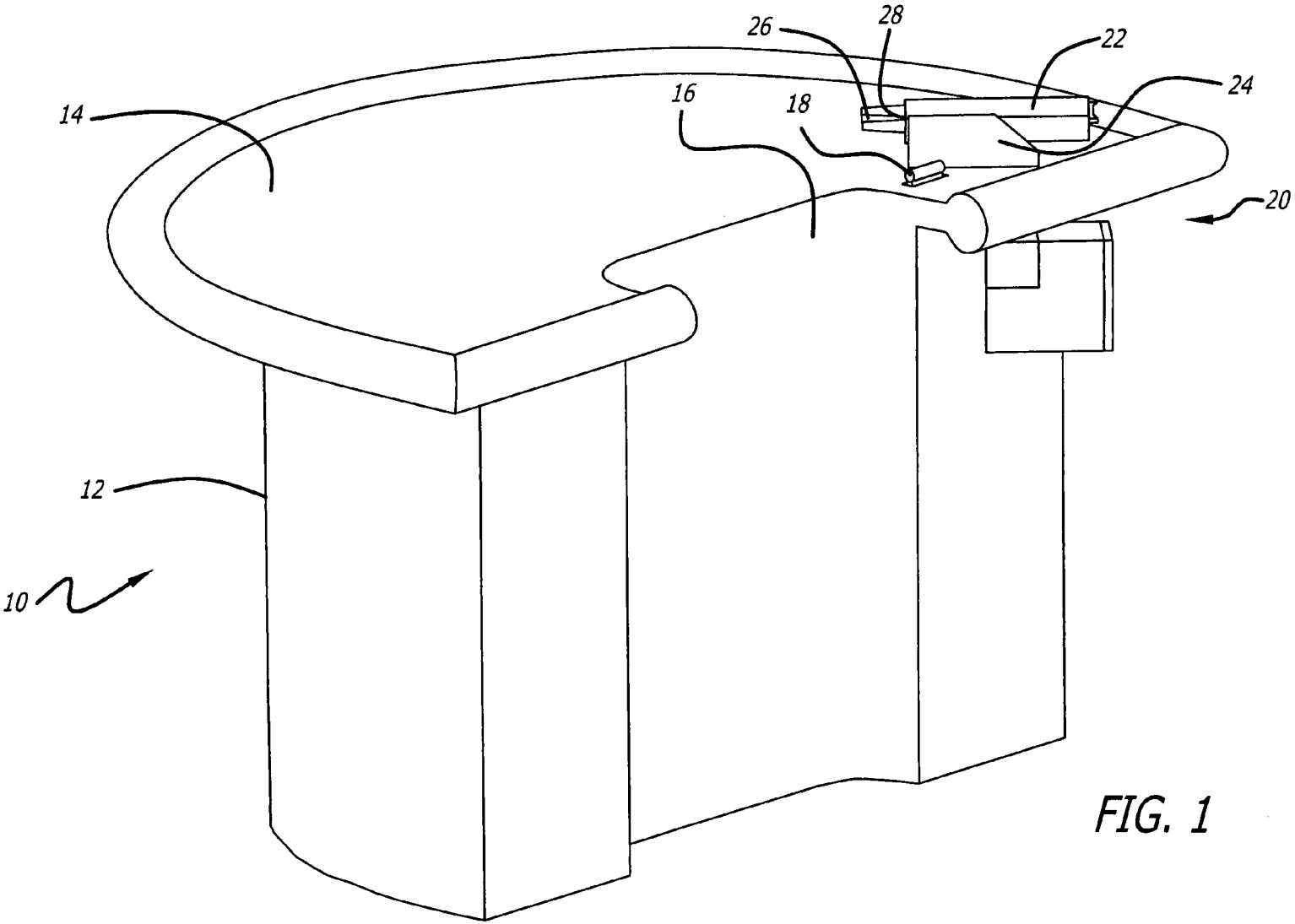
FIG. 1 is a perspective view of a gaming table with an installed bill acceptor.

FIG. 1 provides a perspective view of a gaming table 10 having a base 12 and a playing surface 14. The gaming table 10 has a dealer station 16 opposed by semi-circularly arranged player positions. The gaming table 10 will normally have a drop slot 18, positioned proximate the dealer station 16, which defines a hole in the gaming table 10 and allows for notes to be deposited into a cash box contained proximate the base 12, or within the base. While a card type gaming table is depicted, the invention is applicable to other types of gaming tables.

As further illustrated in the exemplary embodiment of FIG. 1, a bill acceptor 20 is positioned on the playing surface 14 of the gaming table 10. The bill acceptor 20 includes a housing 22 and a mounting bracket 24 to secure the housing 22 to the gaming table 10. The housing 22 includes a bezel 26 upon which notes can be stacked and sequentially fed through a slot 28 into the bill acceptor 20. The slot 28 generally comprises an opening dimensioned to receive the notes.

Figure 2:
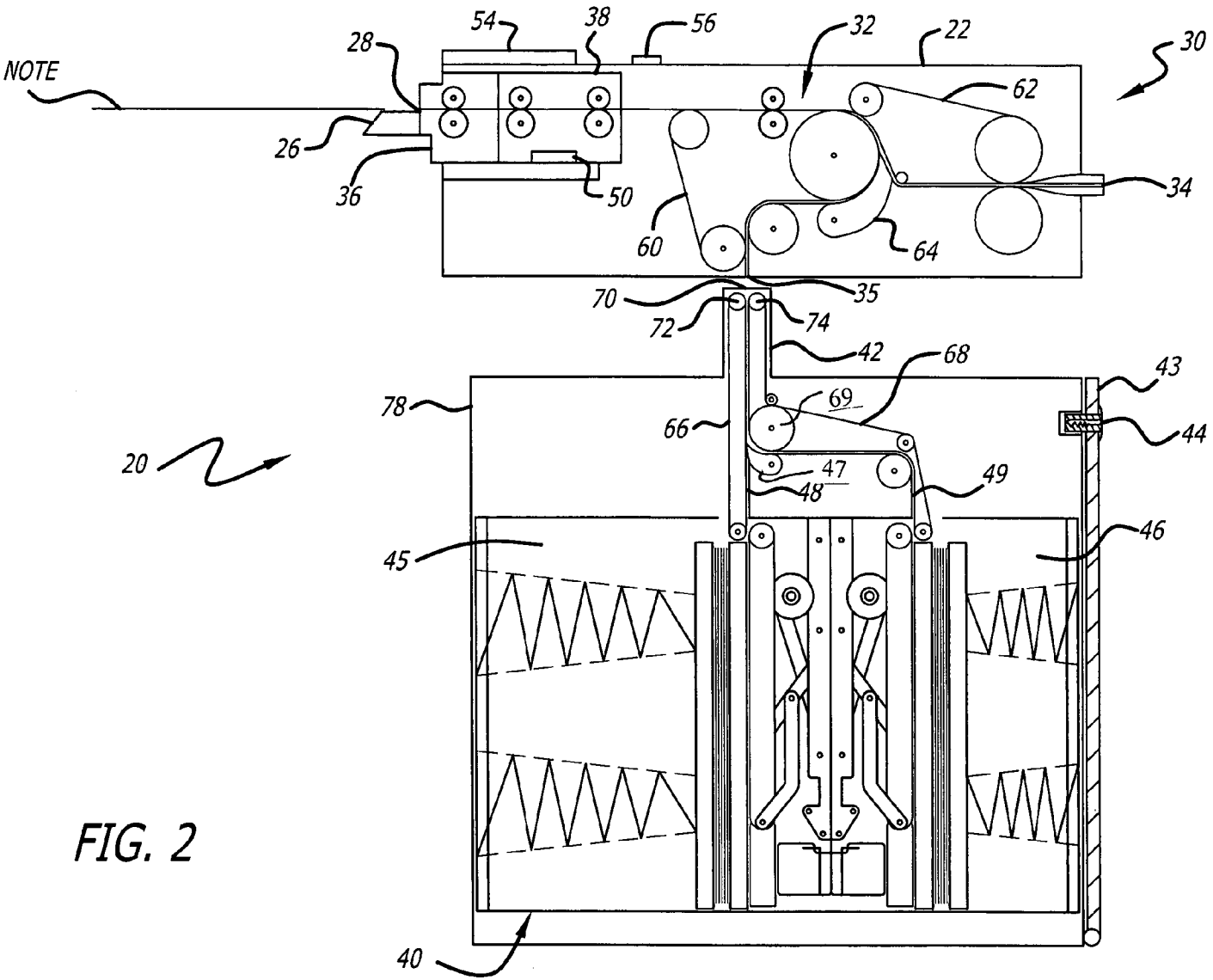
FIG. 2 is a representative cross sectional view of the bill acceptor and a cash box assembly.

FIG. 2 depicts a cross-sectional view of the bill acceptor 20 and an associated cash box 40 removed from the gaming table 10 of FIG. 1. Within the bill acceptor 20, the notes are transported through a validator assembly 30 by a transportation assembly 32, as discussed below. A bill separator 36 may be located proximate the slot 28. The notes pass from the bill separator 36 through a bill discriminator 38 to determine if the notes are authentic. The bill acceptor 20 also includes, at an opposite end of the housing 22, a bill dispenser slot 34. In the event that the bill discriminator 38 determines that a note inserted into the validator assembly 30 is not authentic, the transportation assembly 32 passes the note through the housing 22 to the bill dispenser slot 34.

As illustrated, notes are to be inserted into the bill acceptor 20 through the slot 28. Notes rejected by the validator assembly 30 are ejected through the bill dispenser slot 34. Valid notes are deflected downward through a slot 35 located on the underside of the housing 22 which is to be positioned over the drop slot 18 of the gaming table 10. In an alternative embodiment, the notes are directed to a location along the back edge of the gaming table 10 to then be transported to the cash box 40.

A power assembly 42 draws the valid notes away from the validator assembly 30 and deposits them into the cash box 40, which is to be mounted below the playing surface 14 of the gaming table 10. The power assembly 42 also supplies power to and exchanges information with the validator assembly 30 through a power connector located on the underside of the housing 22 as discussed below. The cash box 40 is contained within a cash box housing 78 having a cash box door 43 and a door lock 44 prevent unauthorized access to the contents of the cash box 40. The cash box 40 may simply be an open container having a slot in the top through which the notes are inserted. As depicted in FIG. 2 the cash box 40 receives and stacks the notes. While the cash box 40 may have a single stacker for all of the notes, it may be preferable to have two stacker sections as depicted, wherein first stacker section 45 receives and neatly stacks currency. A second stacker 46 can be used to stack a selected currency denomination or alternatively all non-currency notes accepted by the bill acceptor. As another alternative, the second stacker 46 could be used to store "fill slips" signifying additional chips being brought to the gaming table. Thus, the second stacker 46 could be used to store all documents, or all non-currency items, received by the bill acceptor. Accordingly, for this dual stacker cash box, the power assembly 42 will have a transport system and a deflector 47 to allow the notes to be directed to the appropriate stacker along a first transport path 48 or a second transport path 49.

The validator assembly 30 contains a circuit board mounted validator processor 50 which is also preferably connected to a central computer or server (not shown) of the casino. The validator processor 50 has various processing capabilities which are known in the art. Upon receipt of a note and determination of validity, a signal is sent to the casino processor or server signifying receipt as well as the denomination of the note. The value of the notes accepted by the validator assembly 30 can then be displayed on an LCD display 54.

There may be situations where some or all of the notes received are rejected from the validator assembly 30 even though it may be apparent to the dealer that the rejected notes are authentic. In this and other situations, the dealer may want to accept the notes in spite of the refusal of the validator assembly 30. To override the decision of the validator assembly 30, the dealer could activate an override input, such as an Accept button 56 which is electrically connected (not shown) to the validator processor 50. Pressing the Accept button 56 will force the validator assembly 30 to accept the notes and the transportation assembly 32 to transport the notes to the cash box 40. Software associated with the bill acceptor 20 can be provided to keep track of the number of notes received as a result of the dealer overriding the validator assembly 30.

If a player wants to place a bet with a dealer operating a casino game on the gaming table 10, casinos generally require the player to use the casino's own tokens to play. The player may already have casino tokens in possession or may give notes to the dealer who will exchange the notes for an equivalent value of casino tokens. To validate the notes received from the player, the dealer or player places the stack of notes on the bezel 26. The bill separator 36 pulls off one note at a time through the slot 28. The technology of bill separators is known in the art, which includes feeding devices such as printers, photocopiers, currency counters, and automated teller machines that feed one sheet of paper, such as a note, from a stack of paper or notes.

The notes are then pulled into the bill discriminator 38 by the transportation assembly 32. Because they are electrically connected to one another, the bill discriminator 38 can instruct the transportation assembly 32 to direct and transport validated notes into the cash box 40 and invalid notes to the bill dispenser slot 34. The transportation assembly 32 includes belts 60 and 62 that transport the note from the bill discriminator 38 to the deflector 64. Depending on the authenticity of the note processed, the bill discriminator 38 will send a signal to a deflector 64 which directs the pathway of the note through the validator assembly 30. If the note is authentic, the deflector 64 will remain in an initial position to direct the notes downwards towards the cash box 40. In the event the note is not authentic according to the bill discriminator 38, the deflector 64 moves from the initial position to a secondary position to deflect the note to an exit or horizontal pathway out of validator assembly 30.

It is understood that the transportation assembly 32 discussed above is an exemplary embodiment for illustration purposes only. Other transportation systems well known or apparent to one skilled in the art are to be included within the scope of the present invention. In addition, in an alternative embodiment, the slot 28 and the bill dispenser slot 34 may be the same.

As illustrated in the cross-sectional view of FIG. 2, the transportation assembly 32 transports valid notes past the deflector 64 to slot 35, which is positioned opposite a narrow extension of the power assembly 42, configured to extend up through the drop slot 18 of the gaming table 10. At the top of the narrow extension is a slit 70 into which the notes are directed. After entering the slit 70, the note passes between two wheels 72 and 74, driven by belts 66 and 68, respectively which draw the note down towards the cash box 40 and away from the validator assembly 30. The belt 66 extends down to the top of the cash box 40 to direct notes to the first stacker 45 of the cash box 40 if a deflector 47 is in an initial position according to the type of note. Belt 68, driven by a motor drive 69 and passing over or around various idler wheels, drives belt 66 and controls the direction of notes directed to the second stacker 46 of the cash box 40 if the deflector 47 moves to a second position.

The bill acceptor 20 may be composed of multiple modules that facilitate installation on a gaming table 10, including for example the mounting bracket 24, the validator assembly 30, and the cash box housing 78 which contains the power assembly 42 as well as the cash box 40. The validator assembly 30 can be an independent component and compact assembly, for example, about the width and length of two U.S. currency bills placed consecutively lengthwise. The mounting bracket 24 is adapted to receive and securely hold the validator assembly 30 to the gaming table 10.

Figure 3:
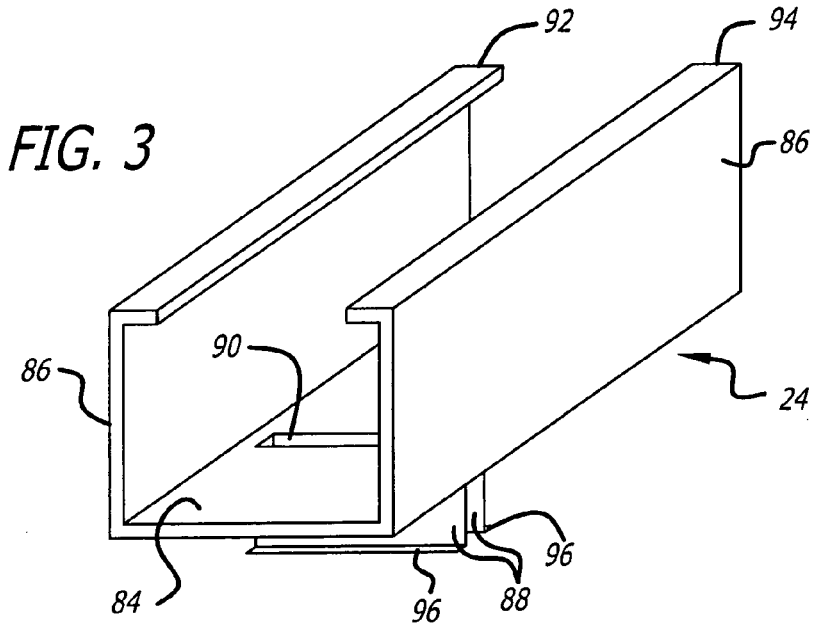
FIG. 3 is a perspective of a mounting bracket for mounting the bill acceptor to the gaming table.

As illustrated in FIG. 3, the mounting bracket 24 may have a base plate 84 that is connected to two plates 86 extending upward and two plates 88 extending downward. The base plate 84 has an opening 90 that is similar in size to the opening of the drop slot 18. The upward plates 86, which rise upward from the base plate 84 and contain overhangs 92 and 94, secure the validator assembly 30 from the top, underside, and each side parallel to the length of the validator assembly 30. A locking mechanism may be provided on the validator assembly 30 so that it can mate and lock with a lock receiver to secure the validator assembly 30 to the mounting bracket 24.

The plates 88, which extend downward from the base plate 84, are parallel to the wider wall of the drop slot 18. The lower ends of the plates 88 extend down the full length of the drop slot 18. At the lower end, the plates 86 may include flanges 96 that clip to the underside of the gaming table 10. To install the mounting bracket 24, the plates 88 are inserted into and pushed through the drop slot 18. After the flanges 96 extend past the end of the drop slot 18, the flanges 96 grip onto the gaming table 10, preventing the removal of the mounting bracket 24. To remove the mounting bracket 24 from the gaming table 10, the flanges 96 must be squeezed together from below the gaming table 10.

Figure 4:
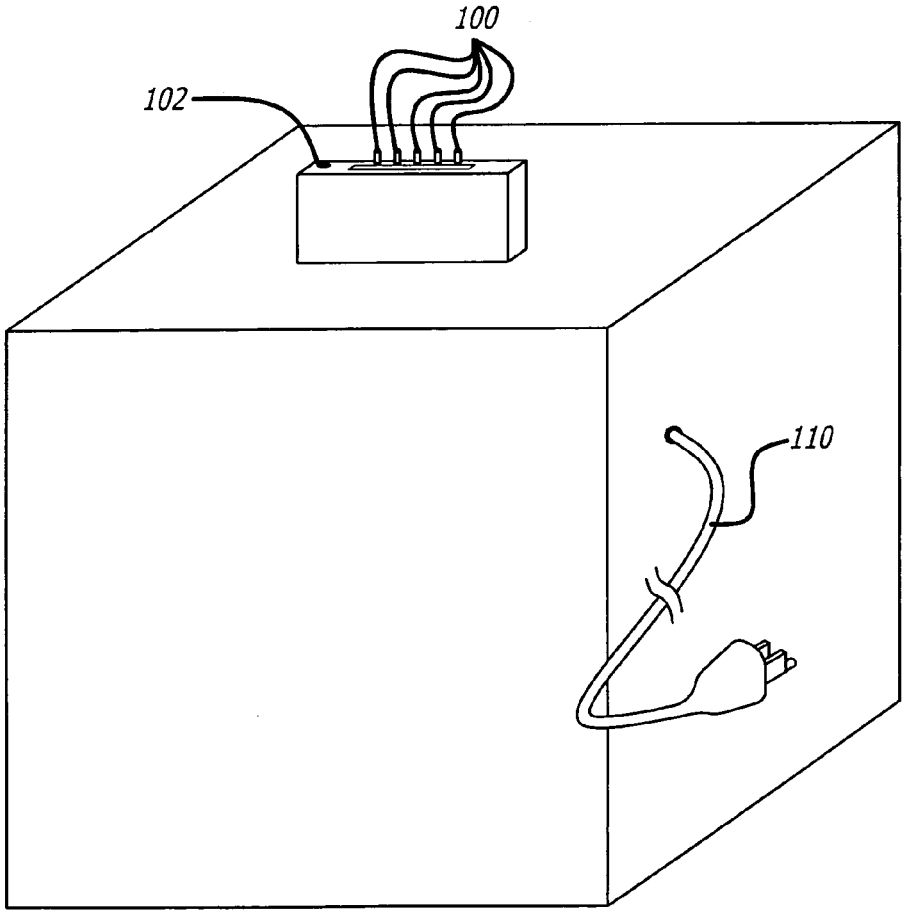
FIG. 4 is a perspective view of a cashbox housing and power assembly of the bill acceptor.

As illustrated in FIG. 4, the top of the narrow extension of the power assembly 42 includes a plurality of pin contacts 100 located extending from the power assembly 42 toward the validator assembly 30. The pin contacts 100 may be spring-loaded to maximize contact between the pin contacts 100 and contacts located on the base of the validator assembly 30. The pin contacts 100 and contacts on the validator assembly 30 are made of alloys that allow transfer of electrical power and data between the validator assembly 30 and the power assembly 42. Alternatively, pin contacts 100 may be used primarily to transfer power from the power assembly 42 to the validator assembly 30, whereas an optical coupling device 102 on the power assembly 42 communicates with an optical coupling device on the validator assembly 30 to transfer data information.

The pin contacts 100 are attached to a power supply and controller in the power assembly 42. A cable 110 can be provided to couple power to the power assembly 42 and also electrically couple the controller of the power supply 42 to a computer server (not shown) in the casino. Alternatively, wireless technology can be used to communicate information between the bill acceptor 20 and a computer server (not shown) in the casino.

Figure 5:
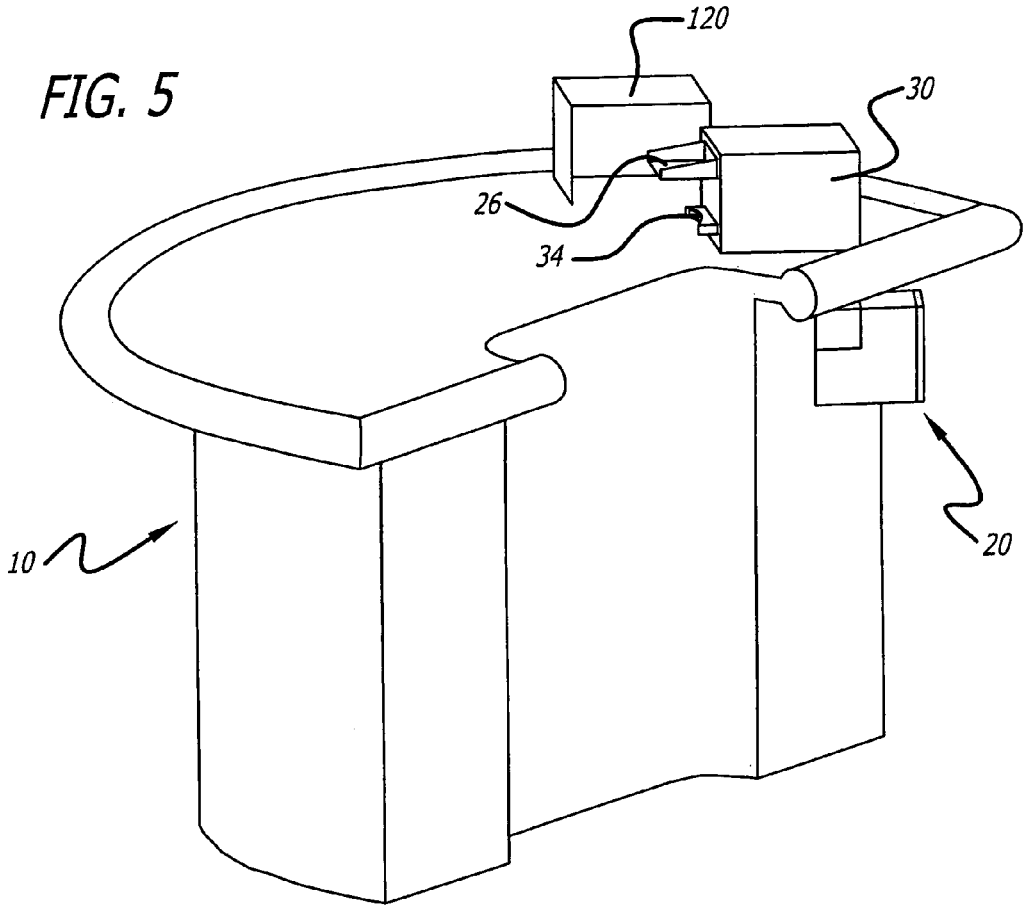
FIG. 5 is a perspective view of an alternative configuration for a bill acceptor and a bill guard installed on a gaming table.

As illustrated in FIG. 5, a bill guard 120 attaches to the gaming table 10 and is positioned near the bill acceptor 20. The bill guard 120 minimizes the possibility that a player could reach onto the gaming table and remove the notes as they were being fed into or rejected from the bill acceptor. The bill guard 120 can be made of a translucent material such as high impact plastic. The bill guard 120 will allow the dealer and players to watch the bills as they are inserted into or rejected from the validator assembly 30. The bill acceptor 20 depicted in FIG. 5 is an alternative embodiment, where the bezel 26 and the bill dispenser 34 are positioned on the same side of the validator assembly 30.

Figure 6:
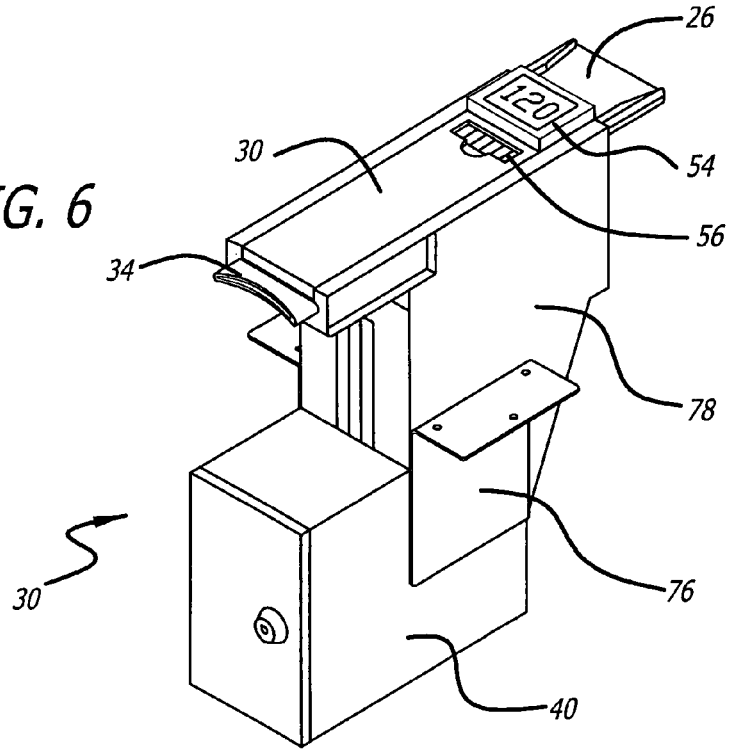
FIG. 6 is a perspective view of another alternative embodiment of a bill acceptor for mounting on a gaming table.

As depicted in an alternative embodiment in FIG. 6, the bill acceptor 30 is enclosed within an integrated housing 78 containing the cash box 40. To install the bill acceptor 20 on the gaming table 10, a hole is cut into the gaming table 10. The hole may need to be larger than the drop slot 18. The bill acceptor 20 is mounted through this hole such that the validator assembly 30 is above the playing surface. 14 and the cash box 40 is below. Mounting members 76 are provided to secure the bill acceptor 30 to the gaming table 10. The internal components of the bill acceptor 30 in the exemplary embodiment, such as the transportation assembly 32, bill separator 36, and the bill discriminator 38, would be used in this alternative embodiment.

In view of the foregoing discussion, it may be readily understood that alternative embodiments are contemplated. For example, a slot for receiving money can be located proximate to each player position. Because the slot includes an opening adapted to receive notes, the slot could be located on the playing surface of the gaming table, along the border of the gaming table or under the playing surface of the gaming table. A player could insert a note into the slot or place the note on a bezel leading to the slot. A bill separator positioned proximate the slot could pull off one note at a time from the bezel. A transportation assembly generally similar to the system disclosed above would transport the note to a bill discriminator. There may be at least one bill discriminator per table to validate notes received from the slots. Valid notes may be transported to one central cash box or a plurality of cash boxes per gaming table. If one bill discriminator is installed proximate to each player position, a cash box may be installed proximate to each bill discriminator. This increases the number of cash boxes that need to be replaced by the casino personnel, but it also increases the cumulative note storage capacity on a gaming table. In addition, the increased storage capacity may decrease the frequency of replacements of filled cash boxes with empty ones. It is also possible to install only one central cash box per gaming table regardless of the number of bill discriminators. In such a configuration a transportation assembly positioned within or below the top of the gaming table will carry valid notes to a cash box and will return invalid notes to the player.

Once the bill discriminator determines the denomination and authenticity of the received note, the bill discriminator may send a signal to an LCD display 54 visible to the dealer and/or the player to indicate how much money a particular player has inserted. The LCD display 54 may indicate the total amount received, or list all of the bills and their amounts in addition to the total amount received. Further, by providing a numeric LCD display 54 showing the amount of received on the surface of the gaming table, security cameras can more readily monitor the intake of money or notes and disbursement of chips by the operator. After giving the equivalent amount in casino tokens to the player, the dealer can reset the reading on the LCD display. In this manner, the dealer can still control when the bets are placed, but doesn't waste time in collecting, counting and verifying the authenticity of the notes collected. In the event the notes are rejected, the notes may be returned through the slot used for inserting money or a separate slot for rejected notes.

Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A multi-player card type gaming table, comprising:

a table having a playing surface, a dealer station and opposingly positioned player positions;

at least one slot for receiving notes from players;

a transportation system for transporting notes from said at least one slot along a transport path;

a validator disposed along said transport path of said note transportation system, said validator configured to identify characteristics of a note being passed therethrough by said transportation system, said validator controlling said transportation system to cause validated notes to be transported on a selected path through said validator;

a cash box assembly including a cash box adapted to receive valid notes passed through said validator and to store valid notes, said cash box being mounted below the surface of said gaming table; and communication circuitry for transferring information from said validator to a remote computer.

2. The multi-player card type gaming table of claim 1, further comprising:

a bill separator for sequentially pulling said notes through said slot and for sequentially passing said notes to said transportation path in advance of said validator.

3. The multi-player card type gaming table of claim 1, said cash box assembly further comprising:

a cash box housing to contain said cash box, said cash box housing including a door and a locking mechanism to secure said cash box within said cash box housing.

4. The multi-player card type gaming table of claim 1, further comprising:

a plurality of signal coupling devices for transferring information from said validator to a controller in said cash box assembly and for providing power from said cash box assembly to said validator.

5. The multi-player card type gaming table of claim 1, further comprising:

a display mounted proximate said dealer station to indicate the value of the notes received and validated by said validator.

6. The multi-player card type gaming table of claim 5 wherein said display is an LCD display.

7. The multi-player card type gaming table of claim 5 wherein said display depicts the denomination of each note validated by said validator.

8. The multi-player card type gaming table of claim 1, further comprising:

an override input to allow a dealer to selectively accept a note which said validator rejects as invalid.

9. The multi-player card type gaming table of claim 1, further comprising:

an optical information coupling system to optically transfer information from said validator to said cash box assembly.

10. The multi-player card type gaming table of claim 1, further comprising:

a plurality of slots, each located proximate at least one player position, for receiving notes from players.

11. The multi-player card type gaming table of claim 10, further comprising:

a plurality of validators, equal in number to and each associated with said plurality of slots, for validating notes received in said plurality of slots.

12. The multi-player card type gaming table of claim 11, further comprising:

a single cash box assembly for receiving and holding notes validated by said plurality of validators.

13. The multi-player card type gaming table of claim 11, further comprising:

a plurality of cash box assemblies, equal in number to and each associated with one of said plurality of validators, for receiving and holding notes validated by said plurality of validators.

14. The multi-player card type gaming table of claim 1, wherein said communication circuitry for transferring information from said validator to a remote computer communicates information concerning the receipt of and denomination of each note received.

15. The multi-player card type gaming table of claim 1, wherein said validator is positioned on top of said table.

16. The multi-player card type gaming table of claim 10, wherein said plurality of slots are located along the border of the gaming table.

17. The multi-player card type gaming table of claim 10, wherein said plurality of slots are located under the playing surface of the gaming table.

18. A multi-player card type gaming table, comprising:

a table having a dealer station and opposingly positioned player positions;

at least one slot for receiving notes from players;

a transportation system for transporting notes from said at least one slot along a transport path;

a validator disposed along said transport path of said note transportation system, said validator configured to identify characteristics of a note being passed therethrough by said transportation system, said validator controlling said transportation system to cause validated notes to be transported on a selected path through said validator;

a cash box assembly including a cash box adapted to receive valid notes passed through said validator and to store valid notes, said cash box being mounted below the surface of said gaming table;

a bill separator for sequentially pulling said notes through said slot and for sequentially passing said notes to said transportation path in advance of said validator;

a plurality of signal coupling devices for transferring information from said validator to a controller in said cash box assembly and for providing power from said cash box assembly to said validator; and a display mounted proximate said dealer station to indicate the value of the notes received and validated by said validator.

19. The multi-player card type gaming table of claim 18, further comprising communication circuitry for transferring information from said validator to a remote computer.

20. The multi-player card type gaming table of claim 18, said cash box assembly further comprising:

a cash box housing to contain said cash box, said cash box housing including a door and a locking mechanism to secure said cash box within said cash box housing.

* * * * *